United States Patent [19]

Saguccio

[11] Patent Number: 4,987,660

[45] Date of Patent: Jan. 29, 1991

[54] HOOK-TYPE CLOTHESPIN

[76] Inventor: Esteban N. Saguccio, 98-626 Moanalua Loop (Apt. #210), Aiea, Hi. 96701

[21] Appl. No.: 422,244

[22] Filed: Oct. 16, 1989

[51] Int. Cl.[5] ..... A44B 13/02

[52] U.S. Cl. ..... 24/567; 24/489; 24/557

[58] Field of Search ..... 24/567, 562, 489, 536, 24/557, 558, 505, 501

[56] References Cited

U.S. PATENT DOCUMENTS

| | | | |
|---|---|---|---|
| 485,758 | 11/1892 | Delug | 24/567 |
| 2,457,026 | 12/1948 | Bergantino | 24/519 |
| 2,542,224 | 2/1951 | Werner | 24/536 |
| 2,644,210 | 7/1953 | McNamee | 24/567 |
| 2,665,466 | 1/1954 | Morgan | 24/567 |
| 3,384,935 | 5/1968 | Salvador | 24/557 |
| 4,553,294 | 11/1985 | Larsen | 24/489 |

FOREIGN PATENT DOCUMENTS

| | | | |
|---|---|---|---|
| 169399 | 11/1959 | Sweden | 24/557 |
| 645814 | 11/1950 | United Kingdom | 24/557 |

*Primary Examiner*—Victor N. Sakran

[57] ABSTRACT

A clothespin with a hook adapted to be attached to a clothesline is disclosed. With the present invention it is possible to attach the clothespin to a clothesline with one's hand lower than the clothesline when hanging the laundry for drying. This is advantageous especially for shorter people or children who may have difficulty stretching up when attaching or detaching the clothespin.

1 Claim, 1 Drawing Sheet

HOOK-TYPE CLOTHESPIN

BACKGROUND OF THE INVENTION

1. Field of the Invention

The invention relates generally to a device for temporarily securing laundry to the clothesline.

2. Description of Prior Art

Clothespins are used to secure clothes and the like on the clothesline when drying. The problem with clothespins currently in use is that when clipping laundry onto the clothesline, one has to have the hand manipulating the clothespin higher than the clothesline, by about three inches, to be able to attach the clothespin. Sometimes it is a problem trying to reach higher than the clothesline especially with shorter or younger people. This new invention could eliminate this problem.

SUMMARY OF THE INVENTION

The present invention is an improved clothespin. It comprises a means such that it can be clipped and unclipped with one's hand manipulating the clothespin lower than the level or height of the clothesline.

The object of the present invention is to provide a clothespin that makes it easier for shorter people and children to clip and unclip laundry without having to stretch up as much as they would with the prior art clothespins.

DESCRIPTION OF THE PREFERRED EMBODIMENT

Figure 1:
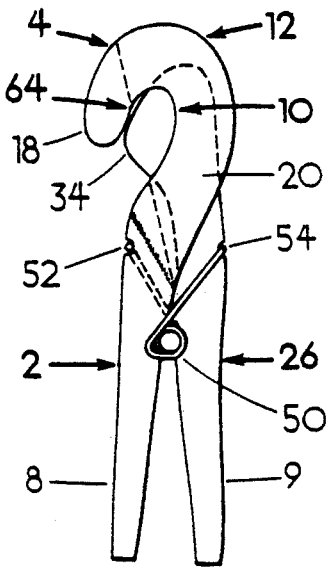
FIG. 1 is the side elevational view of the present invention with the jaws in the normally closed position.

Referring to the different views of the drawing there is shown a preferred embodiment of my new clothespin, made of suitable plastic material and including two clamping members of very different configurations.

Figure 4:
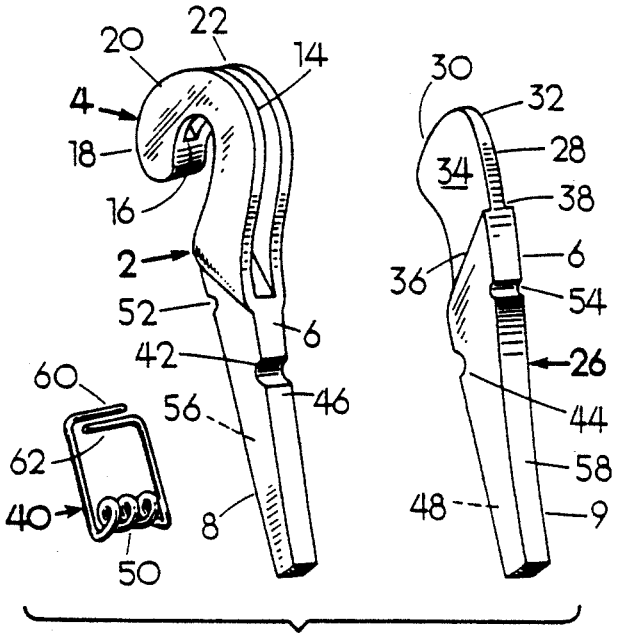
FIG. 4 is an exploded view of the new clothespin.

The first clamping member 2, better illustrated in FIG. 4, includes a hook 4 at the top end, which is an extension of the upper portion 6 of the tail 8. The hook 4 defines an inner circular edge 10 and an outer circular edge 12. A portion close to the tip 18 of the hook 4, at the inner circular edge 10, is the jaw 24 for the first clamping member 2. A closed-ended thru-slot 14, better seen in FIGS. 2 and 4, communicates the inner circular edge 10 and the outer circular edge 12 of the hook 4 and occupying substantially the entire length of the hook, with the exception of a connector portion 16 at the tip 18 of the hook, which serves to strengthen the hook's parallel side plates 20 and 22, and also become portion of the jaw 24, for the first clamping member 2. The hook's side plates 20 and 22 are paralleled apart and are offset outwardly at the base where they branch off with upper portion 6 of the tail 8; this is necessary in order to provide sufficient space for a corresponding portion at the second clamping member 26.

Figure 2:
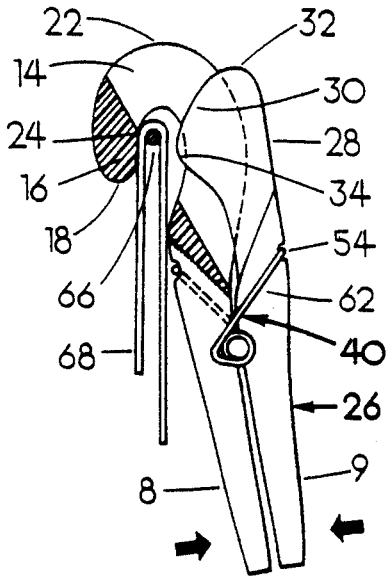
FIG. 2 shows the two tail ends of the clothespin being urged towards each other thus opening the jaws apart.

Referring to FIG. 2, the second clamping member 26 has an increasing width towards the upper end 28 and includes a substantially straight edge, situated intermediate the apex 32 and the chin 34 of the biased end. Said straight edge corresponds to the jaw 30 for the second clamping member. The upper end 28 of the second clamping member 26 has a thickness less then the width of the closed-ended thru-slot 14 starting from the shoulders 36 and 38 and arranged to fit and reciprocate freely within the thru-slot 14 of the first clamping member 2, when manipulated.

The torsion spring 40 adapted for use with the present invention is the same type used with the familiar prior art clothespins. Installation and function is likewise the same and therefore a lengthy detail is deemed not necessary. Transverse notches 42 and 44 are placed on adjacent surfaces 46 and 48 about midpoint of the first 2 and second 26 clamping members respectively to partially contain the coil portion 50 of the spring 40 when assembled as shown. The coil portion 50 of the spring serves as the fulcrum for the corresponding first clamping member 2 and second clamping member 26 of the clothespin. Another pair of much smaller transverse notches 52 and 54 on the outboard surfaces 56 and 58 of the first 2 and second 26 clamping members respectively are located at a particular distance from the larger notches 42 and 44 towards the upper ends. Such small notches 52 and 54 accommodate the spring ends 60 and 62 firmly in place.

When assembled, the new clip device appears as shown in FIG. 1 with the jaw members 24 and 30 being urged in the closed position by the spring 40. It will be seen that a small open segment 64 exists between the jaw 24 of the first clamping member 2 and the jaw 30 of the second clamping member 26 to assure non-slipping of the clip device from the clothesline 66, when used.

Figure 3:
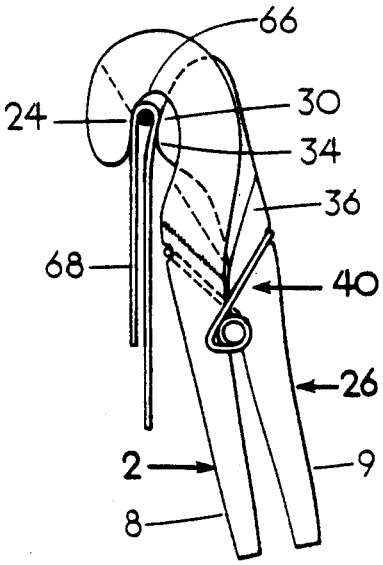
FIG. 3 shows the urging pressures at the tail ends of the device already released, and the jaws gripping onto the clothesline with laundry.

To use the clip device is to urge together the tails 8 and 9, with the fingers in order to open the jaw members 24 and 30 as shown in FIG. 2. The hand manipulating the clip device is then raised to hang the hook 4 onto the clothesline 66 with laundry 68 as shown in FIG. 2. It will be appreciated that the hand manipulating the clothespin will be lower than the height or level of the clothesline 66 when clipping down the laundry 68 with this new device. When the urging pressures on the tails 8 and 9 are released, the laundry 68 is clipped on the clothesline as shown in FIG. 3.

While the instant invention have been shown and described with the preferred embodiment, variations and modifications may be made without departing from the spirit and scope of the appended claims.

What is claimed is:

1. A clothespin attachable onto a clothesline at a level lower than the level of said clothesline, comprising:

(a) a first clamping member in which the top and includes a hook defining generally circular inner and outer edges which are communicated by a closed-ended thru-slot, said closed end portion corresponding to the first jaw thereof;

(b) a second clamping member in which the upper portion includes a reduced thickness to be received within said thru-slot and increased width towards a biased end to limit the extent to which the second clamping member extends into the said thru-slot corresponding to the second jaw thereof;

(a) an elastic means dispensed and adapted to urge said first jaw and said second jaw to normally closed position, said means including a metal spring; and (d) said upper end of said second clamping member is mounted to freely reciprocate within said closed-ended thru-slot when said clothespin is manipulated to grip clothing inserted between said jaws.

* * * * *